United States Patent [19]

Stolz

[11] Patent Number: 4,619,064

[45] Date of Patent: Oct. 28, 1986

[54] MINIATURE FIREARM

[76] Inventor: Yves Stolz, Bourguillards 10, CH-2072 Saint-Blaise, Switzerland

[21] Appl. No.: 763,085

[22] PCT Filed: Apr. 26, 1982

[86] PCT No.: PCT/CH82/00059

§ 371 Date: Dec. 27, 1982

§ 102(e) Date: Dec. 27, 1982

Related U.S. Application Data

[63] Continuation of Ser. No. 456,025, Dec. 27, 1982, abandoned.

[30] Foreign Application Priority Data

Apr. 25, 1981 [CH] Switzerland ..... 2720/81

[51] Int. Cl.[4] ..... F41C 19/00; F41C 3/00; F41C 1/00

[52] U.S. Cl. ..... 42/69.01; 42/54; 42/59

[58] Field of Search ..... 42/7, 8, 54, 58–68, 42/69 R, 69 A, 69 B, 40; 446/406, 144, 145, 401, 473; 63/1 R, 1 A, 2, 13, 20, 23

[56] References Cited

U.S. PATENT DOCUMENTS

| | | | |
|---|---|---|---|
| Re. 633 | 12/1858 | Allen | 42/65 |
| D. 50,354 | 2/1917 | Lefever | D22/1 |
| 137,968 | 4/1873 | Smith | 42/59 |
| 148,742 | 3/1874 | Orr | 42/59 X |
| 358,915 | 3/1887 | Alston | 42/59 |
| 599,135 | 2/1898 | Wildman | 42/54 |
| 660,517 | 10/1900 | Lewis et al. | 42/54 |
| 678,274 | 7/1901 | Owen | 42/62 |
| 1,216,258 | 2/1917 | Andersen | 46/196 |
| 1,308,141 | 7/1919 | Bailey | 42/54 |
| 1,794,364 | 3/1931 | Chilson | 42/54 |
| 2,455,558 | 12/1948 | Burton | 42/54 X |
| 2,733,529 | 2/1956 | Ruger | 42/67 |
| 3,055,270 | 9/1962 | Miller | 42/65 X |
| 3,087,428 | 4/1963 | Frech | 42/69 R X |
| 3,153,874 | 10/1964 | Merrill | 42/8 X |
| 3,158,950 | 12/1964 | Freed | 42/65 |
| 3,267,600 | 8/1966 | Ryan | 42/54 |
| 3,685,193 | 8/1972 | Sefried | 42/62 |
| 4,228,606 | 10/1980 | Casull | 42/59 |

FOREIGN PATENT DOCUMENTS

| | | | |
|---|---|---|---|
| 331150 | of 1976 | Fed. Rep. of Germany | 42/59 |
| 1554157 | 1/1969 | France | 42/59 |

OTHER PUBLICATIONS

Johnson Smith & Co., Detroit, Mich., 1947 Catalog, p. 84.

A History of the Colt Revolver, by Haven and Belden, William Morrow & Co., New York, 1940, pp. 108–110.

NRA's Illustrated Firearms Assembly Handbook, an American Rifleman reprint, pp. 16–17 and 80–82.

*Primary Examiner*—Stephen C. Bentley
*Assistant Examiner*—John E. Griffiths
*Attorney, Agent, or Firm*—Parkhurst & Oliff

[57] ABSTRACT

In its "off" position, the miniature firearm is a scaled-down version of a standard Colt-type revolver. Its length is 4 to 5 cm, its caliber is 2 mm. Its cylinder (5) can receive six rimfire cartridges (7) on a stem (8). Its firing mechanism comprises the sear (18) and the hammer (19). The sear (18), functioning as a trigger, is made integral with a nose (28) which simulates the trigger, a portion (29) which simulates the trigger guard of the standard firearm, a nose (37) which locks the cylinder (5) into the firing position, and a nose (36) which lifts the hammer (19) by means of a retractable pawl. It carries a pawl (32) in front of the cylinder (5). In the position shown, the nose (36) separates from the retractable pawl of the hammer (19) so that a spring housed in the butt (3) and acting simultaneously on the sear (18) and on the hammer (19) will propel the end (26) of the hammer, which takes the place of the firing pin, onto the stem (8) and causes the bullet (9) to be fired.

7 Claims, 8 Drawing Figures

MINIATURE FIREARM

This is a continuation of application Ser. No. 456,025 filed Dec. 27, 1982, now abandoned.

Prior miniature firearms of the same caliber are not shaped so as to constitute a scaled-down version of a standard firearm and they serve to shoot rockets and not to fire bullets.

The miniature firearm of the present invention fills these gaps employing miniature embodiments of two different standard handguns.

In a miniature firearm of this type, which should be capable of functioning, it is nevertheless not possible to scale down all the internal parts of the standard firearm, particularly those of the firing mechanism because the existing ammunition for 2 mm caliber cartridges are designed for rimfire and not for centerfire.

Two embodiments of a miniature firearm according to the invention are shown schematically and solely by way of example in the drawing, in which.

The miniature firearm according to the first embodiment (FIGS. 1 to 5) is a scaled-down version of a Colt-type revolver. It has been designed in the form of a piece of jewelry which can, for example, be worn as a pendant. Barrel 1, frame 2, and butt 3 are made of gold, the latter being studded with brilliants 4. In its natural size, this firearm is 4 to 5 cm long. Its caliber is 2 mm.

Figure 2:
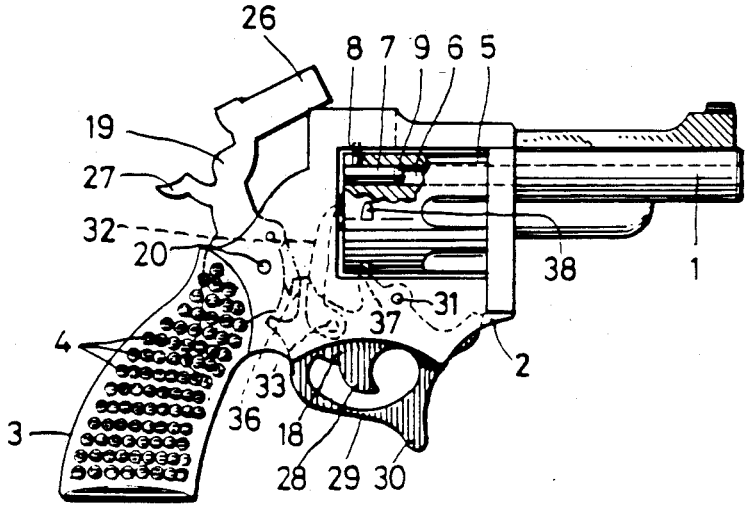
FIG. 2 is the same view but at the moment when the shot is about to be fired.
Figure 3:
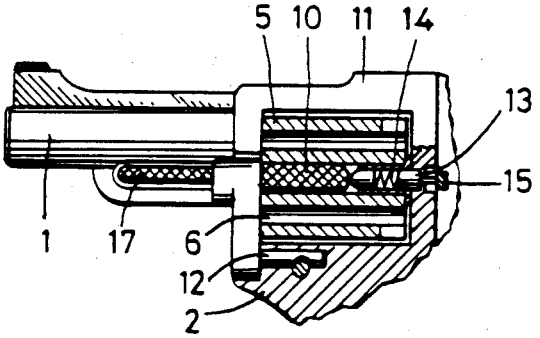
FIG. 3 is a view of a portion of the rear face of this first embodiment, partially in section.
Figure 4:
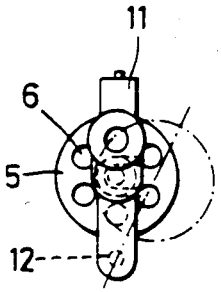
FIG. 4 is an end view of a portion of FIG. 3.
Figure 5:
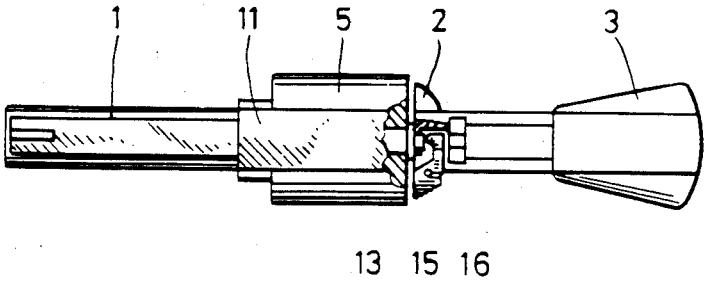
FIG. 5 is a plan view of the firearm of FIG. 3, with a portion in section.

Cylinder 5 of this revolver has chambers 6 for six cartridges 7 (FIGS. 2 to 4). These cartridges are of the rimfire type. By striking radially on the stem 8 (FIG. 2), which juts out of cartridges 7, the charge is ignited and the bullet 9 fired. Cylinder 5 rotates about an axis 10 which is integral with a mount 11 rotating on a pivot 12 (FIG. 3) between the firing position shown by the solid line in FIG. 4 and the loading position indicated by the dash-dotted line in the same figure. A lug 13, pushed into a hole in frame 2 by a spring 14, normally locks mount 11 into the firing position of cylinder 5.

A lever 15, which turns on a pivot at 16 (FIG. 5) on frame 2 allows lug 13 to retract in order to free mount 11, removing it from frame 2 so as to bring cylinder 5 into the loading position. Extractor 17 (FIG. 3) of the empty cartridge case is simulated in simple fashion. If they do not drop by themselves from chambers 6 of cylinder 5, these cartridge cases can be pushed out by means of a pin, for example.

The firing mechanism of the revolver shown is essentially composed of a sear 18 and a hammer 19. The latter rotates about a dowel pin 20 against the action of one end of a spring 21 which is wound about a lug 22 of butt 3. It carries a pawl 23 which turns on a pivot at 24 and is subjected to the action of a thrust spring 25. Compared with the standard revolver, whose hammer carries a firing pin which strikes the wafer located in the center of the bottom of the cartridge case, the site of the pivoting point 20 of hammer 19 has been modified so that hammer end 26, which serves as a firing pin, falls vertically on stem 8 of cartridge 7 contained in upper chamber 6 of cylinder 5 starting from the position in FIG. 2. Like the hammer of the standard revolver, that of the revolver described herein has been constructed with a nose 27, which allows it to be operated manually in the position shown in FIG. 1. However, in the firing position, hammer 19 is not held mechanically.

In the miniature revolver, nose 28 of sear 18, which simulates the trigger of the standard revolver, would not be accessible in trigger guard 29 if the latter were integral with frame 2. In the revolver described herein, this portion 29 which, in the non-firing or "off" position represents the trigger guard of the standard revolver, has been constructed with sear 18 and, in order to enable the shooter to fire a shot, he must act on its nose 30, which takes the place of a trigger.

Figure 1:
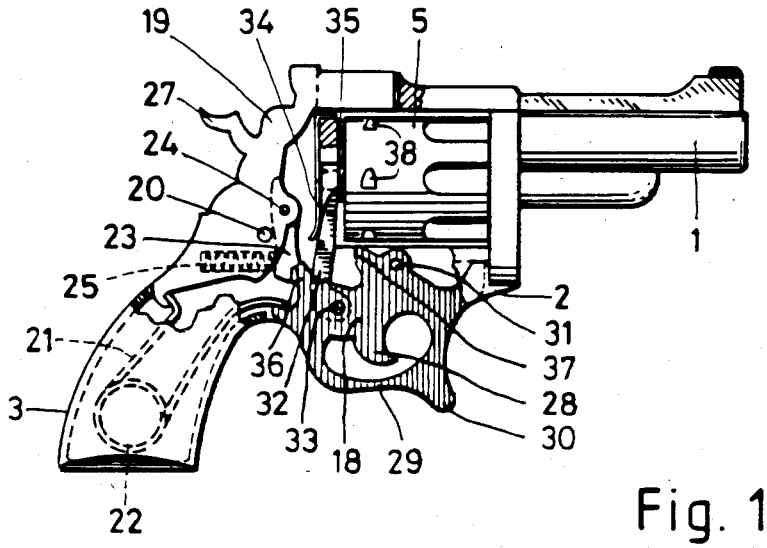
FIG. 1 is a front view of a first embodiment in the "off" position, in which certain portions have been broken away.

Sear 18 is subjected to the action of the other end of spring 21, which tends to hold it in the position shown in FIG. 1. It rotates about a pin 31 and carries a pawl 32 turning on a pivot at 33 and subjected to the action of a spring plate 34, which causes the end of pawl 32 to be pressed against the peg teeth of toothing 35 of cylinder 5.

By pressing trigger 30, sear 18 is made to rotate about pin 31. Sear 18 lifts pawl 32, which causes cylinder 5 to advance one step so as to bring another chamber 6 into line with barrel 1. At the same time, nose 36 of sear 18 seizes pawl 23 of hammer 19, which causes the latter to be lifted. At the end of its travel, another nose 37 of sear 18 deeply engages a notch 38 of cylinder 5 so as to lock the latter firmly into a position where chamber 6, which has reached the upper position of revolver 5, is brought very accurately into line with the bore of barrel 1. At the same time, nose 36 of sear 18 separates from pawl 23 so that hammer 19 is freed. Spring 21 propels the end 26 thereof on stem 8 of cartridge 7 contained in upper chamber 6 of barrel 6, which causes the shot to be fired.

When trigger 30 is released, spring 21 brings it back to the position shown in FIG. 1, pawl 32 falls again, sliding on top of one of teeth 35 of cylinder 5, and, in passing, its nose 36 retracts pawl 23, which moves aside against the action of spring 25.

If cylinder 5 is filled with six cartridges 7, the latter can be fired one after the other simply by pressing trigger 30 six times in succession. In the "off" position depicted in FIG. 1, cylinder 5 is, in principle, free to turn about its axis. However, in order to be able to turn at will, hammer 19 must be lifted slightly by acting on its nose 27 so that the stems 8 of cartridges 7 can pass underneath its end 26.

To ensure that cylinder 5 does not cause pawl 32 to move back when trigger 30 is released in the position illustrated in FIG. 2, it suffices to adjust the plate of spring 34 so that the friction of pawl 32 on teeth 35 will be much less than that of cylinder 5 rotating about its axis 10.

Figure 6:
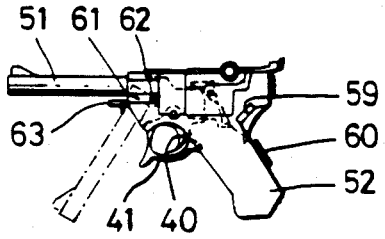
FIG. 6 is a front view of a second embodiment, in its natural size.
Figure 7:
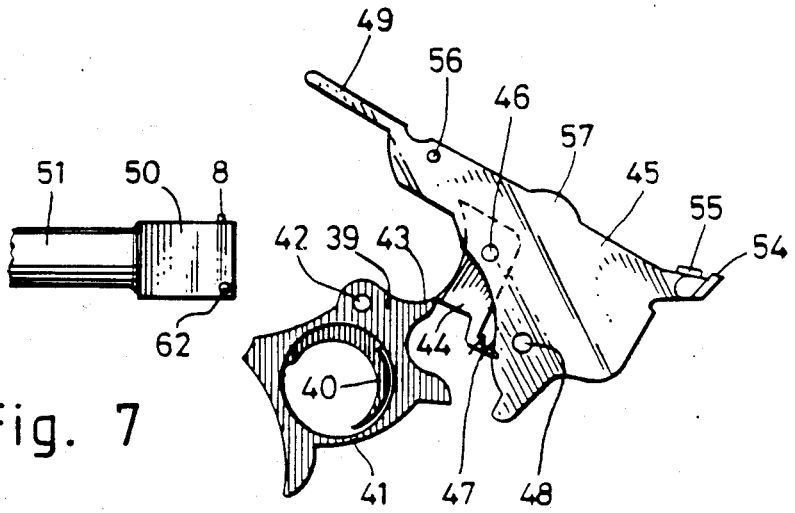
FIG. 7 is a scaled-up view of the parts of the firing mechanism in the position they occupy at the instant when the shot is about to be fired.
Figure 8:
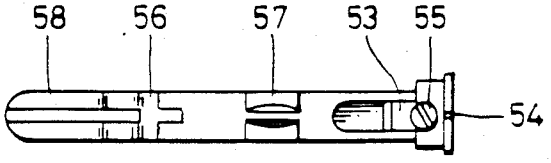
FIG. 8 is a plan view of one of the parts of FIG. 7.

In the "off" position shown in FIGS. 6 to 8, the second embodiment of the firearm embodying the invention is a reduced version of the automatic pistol. Its caliber is the same as that of the revolver shown in FIGS. 1 to 5. It is loaded with the same ammunition. FIG. 6 shows this miniature pistol in its natural size.

As in the case of the first embodiment, its firing mechanism is completely different from that of the standard pistol. Its principal parts are shown schematically in FIG. 7. They also comprise a sear 39 made integrally with a first portion 40 which simulates the firing mechanism of the standard pistol, and a second portion 41 which simulates the trigger guard of this standard pistol. Sear 39 turns on a pivot at 42 and its nose 43 seizes a pawl 44 mounted on hammer 45. Pawl 44 turns on a pivot at 46 on hammer 45 and it is subjected to the action of a spring 47. Hammer 45, for its part, turns on a pivot at 48, and its end 49 serving as a firing pin will strike stem 8 of the cartridge contained in bore 50 of barrel 51 of the pistol when nose 43 of sear 39 separates from pawl 44. The parts of the firing mechanism are shown in FIG. 7 in the respective positions they occupy at the moment when nose 43 separates from pawl 44 and when the shot is about to be fired. As in the first embodiment, sear 39 and hammer 45 are subjected to the action of a spring (not shown) contained in butt 52 of the pistol and which tends to hold these two parts in the "off" position.

FIG. 8 is a plan view of the upper edge of hammer 45. It shows that the edge in question is shaped such as to represent the sight plate 53 with sighting assembly 54 and adjustment screw 55, as well as joints 56, 57 of the toggle joint of the standard pistol, which is actuated by pulling joint 57 upward and rearward so as to cause the cartridge-case base 58 to slide, to seize a cartridge in the magazine contained in the butt and to bring it into the bore of the barrel, or which bends back when the shot is fired in order to eject the empty cartridge case from the bore of the barrel and allow a new cartridge to pass, thereby assuring the automatic functioning of the pistol. On the miniature pistol described herein, there are thus simulated: the lever 59 of the safety catch (FIG. 6), the safety plunger 60 mounted on butt 52, and the locking lever 61 of the barrel and of the cartridge-case base on the frame of the standard pistol.

The miniature pistol described herein is, however, not automatic; it does not have a magazine. It must be reloaded after each shot. To accomplish this, the barrel and its bore 50 are hinged at 62 on the frame so that they can tip as far as the position indicated by the dash-dotted line in FIG. 6 (after slighly lifting hammer 45), and to open the bore of barrel 51 in the manner of the barrels of hunting rifles. In the firing position, barrel 51 is locked to the frame by a sliding rod 63.

The pistol described herein can be set in jewels, like that of the first embodiment, and have its butt 52 decorated with brilliants.

It will be noted that by integrating into the parts of the firing mechanism some external portions of the standard pistol that are alien to the latter, it was possible to make these parts relatively large in the firearms according to the invention so as to permit ease of handling and to ensure a simple and reliable operation of these firearms despite their extremely small size.

I claim:

1. An operational miniature firearm approximately 4 to 5 centimeters in size comprising:

a gun body and butt;

a barrel attached to said body and having a bore caliber of about 2 millimeters;

a rimfire projectile cartridge holding means aligned with the bore of said barrel for holding a rimfire projectile cartridge with a projectile of suitable caliber for firing along said bore;

a hammer means pivotally mounted on said gun body to strike and thereby fire any such suitable caliber rimfire projectile cartridge held in said holding means;

first spring means for biasing said hammer means towards said holding means;

a pawl pivotally mounted on said hammer means and having one end projectable away from said hammer means;

second spring means for biasing said pawl away from said hammer means; and a sear pivotally mounted on said body and abuttable against said pawl, such that when said sear is pulled towards said gun butt it first pushes said hammer means upwards through said pawl, thereby to cock said hammer means, and then releases said hammer means by passing beyond said pawl, whereupon said first spring means causes said hammer means to strike and fire any such suitable caliber rimfire projectile cartridge in said cartridge holding means;

wherein said sear has an opening formed therethrough in a portion thereof substantially external to said gun body and butt when said sear is in a rest position, edges of said opening away from said gun body and butt being defined by a thin border portion of said sear having the shape of a trigger guard, and wherein said sear further has a protruding portion having the shape of a trigger and extending into said opening on a side thereof closest to said gun body.

2. The operational miniature firearm of claim 1, wherein the rimfire projectile cartridge holding means further comprises a cylinder rotatably mounted to said gun body and having a plurality of spaces formed therein for holding a plurality of suitable caliber rimfire projectile cartridges, each said space being alignable with said barrel bore for firing a sutable caliber projectile therethrough, and wherein said miniature firearm further comprises a second pawl pivotally mounted to said sear and abutting against said cylinder such that said second pawl rotates said cylinder each time said sear is pulled, thereby to bring successive spaces of said plurality of spaces into alignment with said barrel bore.

3. The operational miniature firearm of claim 1, wherein said miniature firearm further comprises a pendant.

4. The operational miniature firearm of claim 1, wherein said gun butt has an outer surface, said outer surface being studded with at least one decoration selected from the group consisting of brilliants and jewels.

5. The operational miniature firearm of claim 1, wherein said miniature firearm barrel, body and butt are made with at least one precious metal.

6. The operational miniature firearm of claim 1, wherein said hammer means comprises:

a hammer;

a nose extending rearwardly from said hammer in a direction away from said gun body allowing said hammer means to be manually operated;

a hammer end extending forwardly from said hammer along said gun body such that when said hammer means is cocked and released said hammer end will strike and fire any such suitable caliber rimfire projectile cartridge in said cartridge holding means, a surface of said hammer end away from said gun body being shaped to resemble a continuation of an adjacent surface of said gun body when said hammer means is in a rest position;

wherein said hammer, nose and hammer end are integrally formed of a single piece of material.

7. The operational miniature firearm of claim 4, wherein said hammer means comprises:

a hammer;

a rear projection extending from said hammer in a direction away from said gun body and shaped to resemble a sighting assembly and an adjustment screw;

a hammer end extending forwardly from said hammer along said gun body such that when said hammer means is cocked and released said hammer end will strike and fire any such suitable caliber rimfire projectile cartridge in said cartridge holding means, a surface of said hammer and hammer end away from said gun body being shaped to resemble toggle joints of an automatic pistol;

wherein said hammer, rear projection and hammer end are integrally formed of a single piece of material.

* * * * *